US007703518B2

(12) United States Patent
Phillippi et al.

(10) Patent No.: US 7,703,518 B2
(45) Date of Patent: Apr. 27, 2010

(54) DUST CONTROL SYSTEM FOR TRANSFERRING DRY MATERIAL USED IN SUBTERRANEAN WELLS

(75) Inventors: Max Phillippi, Duncan, OK (US); Calvin Stegemoeller, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 393 days.

(21) Appl. No.: 11/746,163

(22) Filed: May 9, 2007

(65) Prior Publication Data

US 2008/0277121 A1 Nov. 13, 2008

(51) Int. Cl.
*E21B 43/40* (2006.01)

(52) U.S. Cl. ..... 166/267; 175/66; 175/206; 55/428; 55/429; 55/466; 96/378

(58) Field of Classification Search ..... 166/267; 175/66, 206; 55/428, 429, 459.1, 466; 96/378; 406/168, 173

See application file for complete search history.

(56) References Cited

U.S. PATENT DOCUMENTS

| | | | | |
|---|---|---|---|---|
| 2,712,476 | A * | 7/1955 | Happel | 406/49 |
| 3,212,197 | A * | 10/1965 | Crawford | 34/371 |
| 3,392,831 | A | 7/1968 | Eckardt | |
| 3,777,405 | A | 12/1973 | Crawford | |
| 4,328,913 | A | 5/1982 | Whiteman | |
| 4,499,669 | A | 2/1985 | Haeck | |
| 4,802,141 | A | 1/1989 | Stegemoeller et al. | |
| 6,948,535 | B2 | 9/2005 | Stegemoeller | |
| 7,104,328 | B2 | 9/2006 | Phillippi et al. | |

FOREIGN PATENT DOCUMENTS

| | | |
|---|---|---|
| GB | 1 015 346 | 12/1965 |

OTHER PUBLICATIONS

Foreign communication related to a counterpart application dated Dec. 8, 2008.

* cited by examiner

*Primary Examiner*—Jennifer H Gay
*Assistant Examiner*—Sean D Andrish
(74) *Attorney, Agent, or Firm*—John W. Wustenberg; Conley Rose, P.C.

(57) ABSTRACT

A portable well treating fluid mixing system includes: a supply tank having an inlet receiving pneumatically conveyed dry treating material; a cyclone separator having an inlet coupled to the supply tank and receiving dust laden air from the supply tank, and having a first outlet venting clean air and having a second outlet venting solids; a collection container having a first inlet coupled to the cyclone separator second outlet and receiving solids from the cyclone separator and having an outlet; and, a pump having an inlet coupled to the collection container outlet and a pump outlet coupled to the supply tank. In operation, the system continuously conveys dust from the collection container back into the supply tank to maintain the separator in proper operating condition and minimizes venting of dust during the transfer of material to the supply tank.

20 Claims, 3 Drawing Sheets

DUST CONTROL SYSTEM FOR TRANSFERRING DRY MATERIAL USED IN SUBTERRANEAN WELLS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention is directed to systems and methods for mixing dry treating materials with liquids to provide treating fluids for wells. More particularly the invention is directed to systems and methods for controlling dust generated in the transfer of dry treating materials into a supply tank in a portable system for hydrating the dry treating material to form a treating fluid or slurry.

BACKGROUND OF THE INVENTION

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing operations. The high viscosity fluids are normally produced by mixing dry powder and/or granular materials and agents with water at the well site as they are needed for the particular treatment. Systems for metering and mixing the various materials are normally portable, e.g. skid or truck mounted, since they are needed for only short periods of time at a well site.

The powder or granular treating material is normally transported to a well site in a commercial or common carrier tank truck. Once the tank truck and mixing system are at the well site, the dry powder material must be transferred or conveyed from the tank truck into a supply tank for metering into a mixer as needed. The dry powder materials are usually transferred from the tank truck pneumatically. In the pneumatic conveying process, the air used for conveying must be vented from the storage tank and typically carries an undesirable amount of dust with it.

Cyclone separators are typically used to separate the dust from the vented air. However, cyclone separators which are small enough to be included with a portable mixing system have a limited capacity for storing solids separated from the air. When the dust collection container is filled, the collected dust may fill or clog the cyclone separator and dust is undesirably vented with what should be clean air. To prevent undesirable dust discharge, the system must be stopped while the collection container is emptied.

SUMMARY OF THE INVENTION

A portable well treating fluid mixing system includes a supply tank having an inlet receiving pneumatically conveyed dry treating material; a cyclone separator having an inlet coupled to the supply tank and receiving dust laden air from the supply tank, and having a first outlet venting clean air and having a second outlet venting solids; a collection container having a first inlet coupled to the cyclone separator second outlet and receiving solids from the cyclone separator and having an outlet; and a pump having an inlet coupled to the collection container outlet and a pump outlet coupled to the supply tank.

In an embodiment, the collection container includes a second inlet adapted for directing a flow of compressed air through the collection container and toward the collection container outlet.

A method for operating a portable well treating fluid mixing system includes pneumatically conveying dry treating material from a bulk storage tank to a supply tank; flowing solids laden air from the supply tank to an inlet of a cyclone separator, the cyclone separator having a clean air outlet and a solids outlet; collecting solids from the cyclone separator solids outlet in a collection container; and conveying solids from a collection container outlet.

DESCRIPTION OF THE EMBODIMENTS

The disclosed systems and methods relate to the transfer of dry materials (e.g. dry gels, cement, etc.) used for various well treatments. The dry treating materials are typically supplied in the form of powder and/or granular material, and usually comprise a mixture of various particle sizes. The particles are generally small enough to be pneumatically conveyed through pipes and hoses. The smallest particles may be referred to as dust or powder. The term dry treating material is used herein to refer to any conventional dry well treating material that may be pneumatically conveyed.

Figure 1:
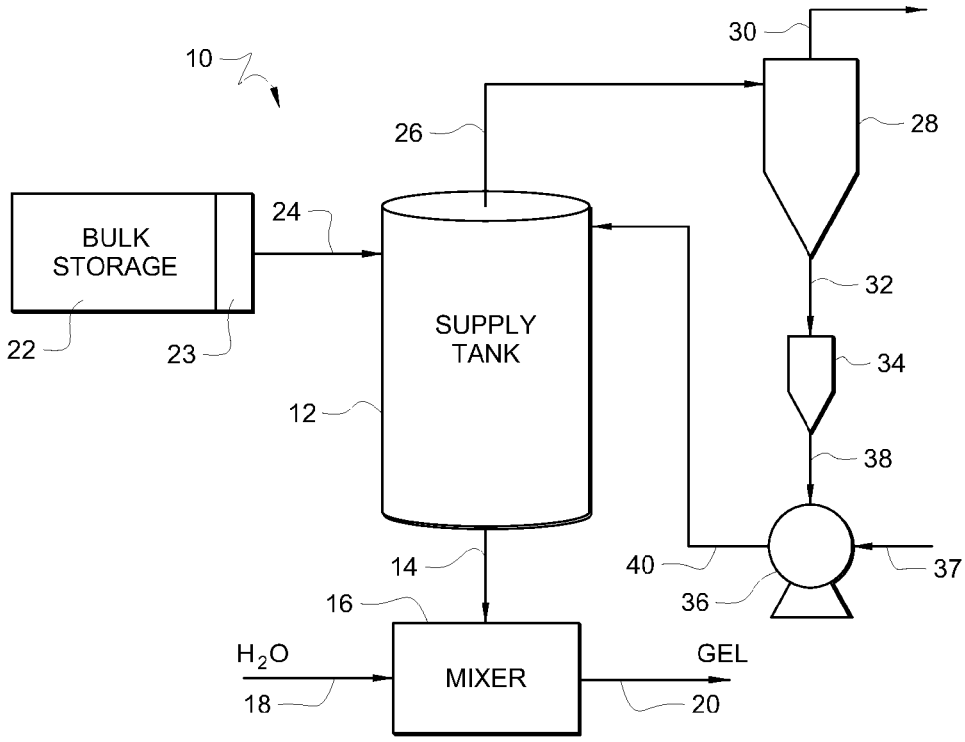
FIG. 1 is a block diagram of a portable mixing system suitable for mixing dry materials with liquids to form well treating fluids at a well site.

With reference to FIG. 1, a dry treating material mixing system 10 will be described. The system 10 includes a supply tank 12 for holding a quantity of dry treating material. The supply tank 12 preferably includes a metering system for providing a controlled, i.e. metered, flow of dry treating material at an outlet 14. A typical supply tank with a metered output used in a well treating fluid system like that of the present embodiments is shown in U.S. Pat. No. 6,948,535, which is incorporated by reference herein in its entirety. The outlet 14 conveys the dry treating material from supply tank 12 to a mixer 16. Water and other additives may be supplied to the mixer 16 through an inlet 18. The dry treating material and water are mixed in mixer 16 and a gel, cement slurry, or other treating fluid may be produced at an outlet 20. The outlet 20 may be coupled to a pump for conveying the treating fluid into a well (e.g., a hydrocarbon recovery well) for a treating process.

The supply tank 12 is part of a portable, e.g. skid or truck mounted, treating fluid mixing system and thus is limited in size and the amount of dry treating material it can hold. A portable bulk storage tank 22 is normally provided at a well site for storing a supply of dry treating material. The dry treating material is normally transported to the drilling site in a tank truck. The bulk storage tank 22 may be the tank truck itself or may be a stand alone tank (e.g., skid or trailer mounted). Before a treatment begins, a quantity of dry treating material must be transferred from the storage tank 22 to the supply tank 12 as indicated by the arrow 24. This transfer is normally made by a pneumatic conveying system 23 which fluidizes the material in storage tank 22 with a flow of air. Pneumatic conveying systems are typically built into tank trucks used to ship dry powdered or granular materials and/or built into free standing bulk storage tanks. The fluidized material may flow through a pipe, hose, or other conduit from the bulk storage tank 22 into the supply tank 12. Once the material enters the supply tank 12, most of the solids settle to the lower portion of tank 12. The air used to convey the material is vented from an outlet 26 at or near the top of tank 12. While most of the solids settle out in the tank 12, the vented air may carry an undesirable amount of powder or dust (e.g., solids or powder laden air).

The powder laden air from vent 26 flows to an inlet of a cyclone separator 28. When operating properly, the separator 28 separates the solids from the air. The clean air is vented from the top of the separator at 30. The solids drop out of the bottom of separator 28 at outlet 32 and are collected in a collection container 34. The collection container 34 is of limited capacity, especially in portable systems. If the collection container 34 is allowed to fill with treating material, the material would begin to fill the cyclone separator 28 and/or clog outlet 32 and powder would be vented out the clean air vent 30. In prior art systems, this limits the amount of material that may be continuously transferred into a supply tank 12. Once the collection container 34 is filled, the transfer would have to be stopped while the collection container 34 is emptied to restore the proper operation of the separator 28. Stopping the transfer would interfere with a well treating process.

According to the present disclosure, additional elements are provided to empty the collection container 34 and allow transfer of material into the supply tank 12 on an essentially continuous basis. In an embodiment, a pump 36 or other conveyance device is provided to remove material from the collection container 34. In this embodiment, the pump 36 pumps the material from collection container 34 back into the supply tank 12. The pump 36 has an inlet, or suction inlet, connected to the collection container 34. A pump outlet 40 is coupled to the supply tank 12. The pump 36 could be operated intermittently as needed to empty the collection container 34, but preferably is operated continuously. As a result, there is no build up of solids in the separator 28 and it continues to effectively separate the powder from the inlet air and vent clean air as desired.

In various embodiments, the pump 36 is powered by a flow of pressurized air as indicated by the arrow 37. Trucks capable of transporting a well treating fluid mixing system normally include an air compressor. Air supplied from such compressors has been found sufficient to power the pump 36 and continuously transport dust from collection container 34.

In one embodiment, an air driven double diaphragm pump, model NDP-25 BAN, sold by Yamada America, Inc. may be used as pump 36 to continuously pump powder material from the collection container 34 into the supply tank 12. This pump model is intended for use in pumping liquids, but was found to be effective in pumping the powder or dust from collection container 34 back into the supply tank 12. It is preferred to operate pump 36 continuously. This type of pump may be operated continuously even if no material is actually being pumped. Other similar pumps, such as those supplied under the trademark SANDPIPER by the Warren Rupp, Inc. company are believed to be useful as pump 36. Other pumps or conveyance devices suitable for pumping or conveying dry powder or dust may be used as pump 36, if desired.

With further reference to FIG. 1, it may appear that advantages of the disclosed embodiments could be achieved if the outlet 40 of pump 36 were directed to a secondary collection container or back to the bulk storage tank 22. However, the disclosed embodiments are directed to portable systems in which space is not available for a larger collection container and likewise space is not available for a secondary collection container. Even a secondary collection container would eventually fill and limit the time in which continuous transfers of dry treating materials into the supply tank 12 can occur. If the outlet of pump 36 is directed to any other container, there is also the likelihood that dust would be released from the other container, which is undesirable. The disclosed arrangement avoids these problems by pumping the collected dust back to the supply tank 12, which effectively has an unlimited capacity in supplying mixer 16, and which directs any dust created by the pump 36 back into the separator 28.

Figure 2:
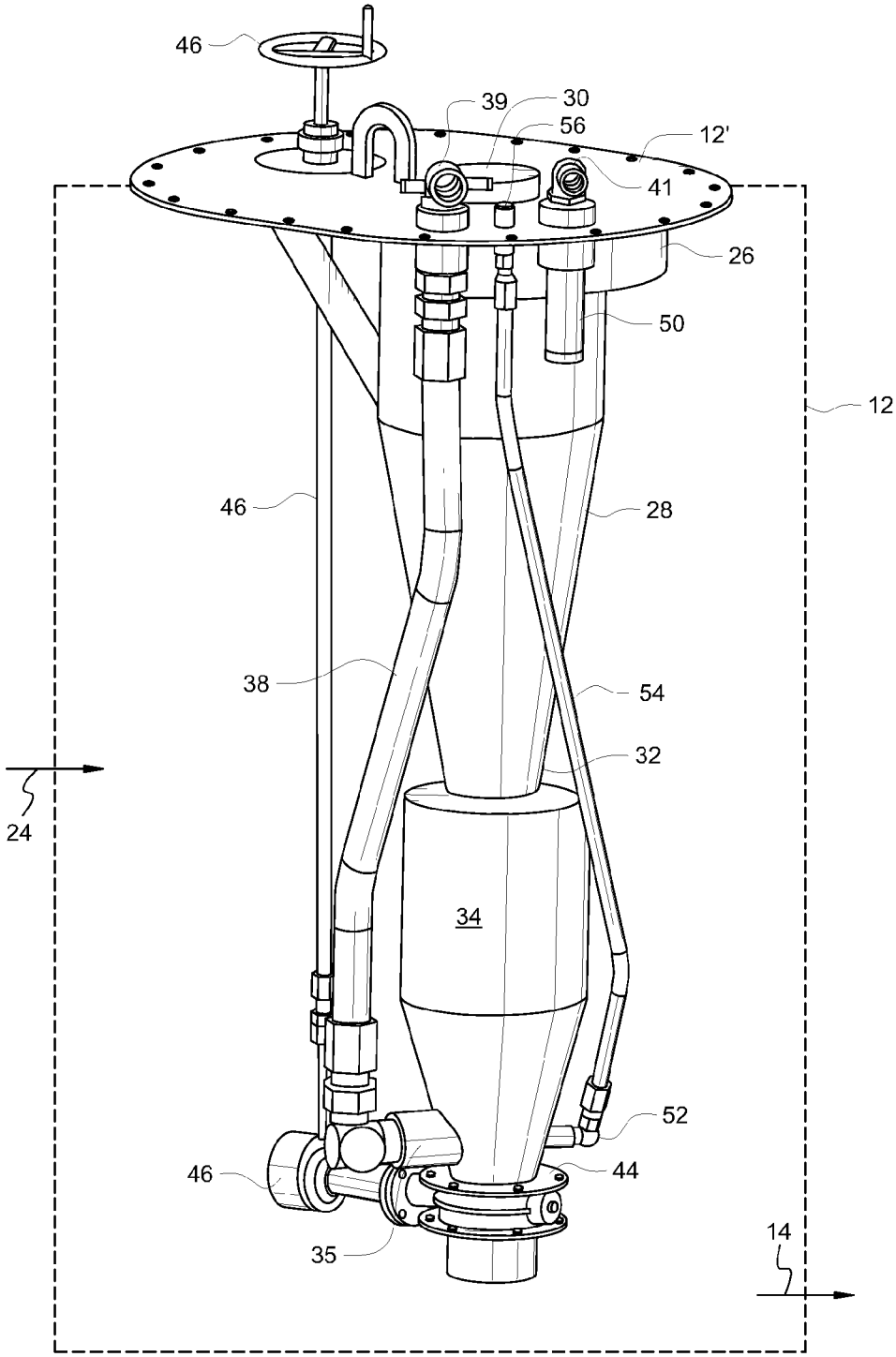
FIG. 2 is a perspective view of an embodiment of a cyclone separator system from a first direction.
Figure 3:
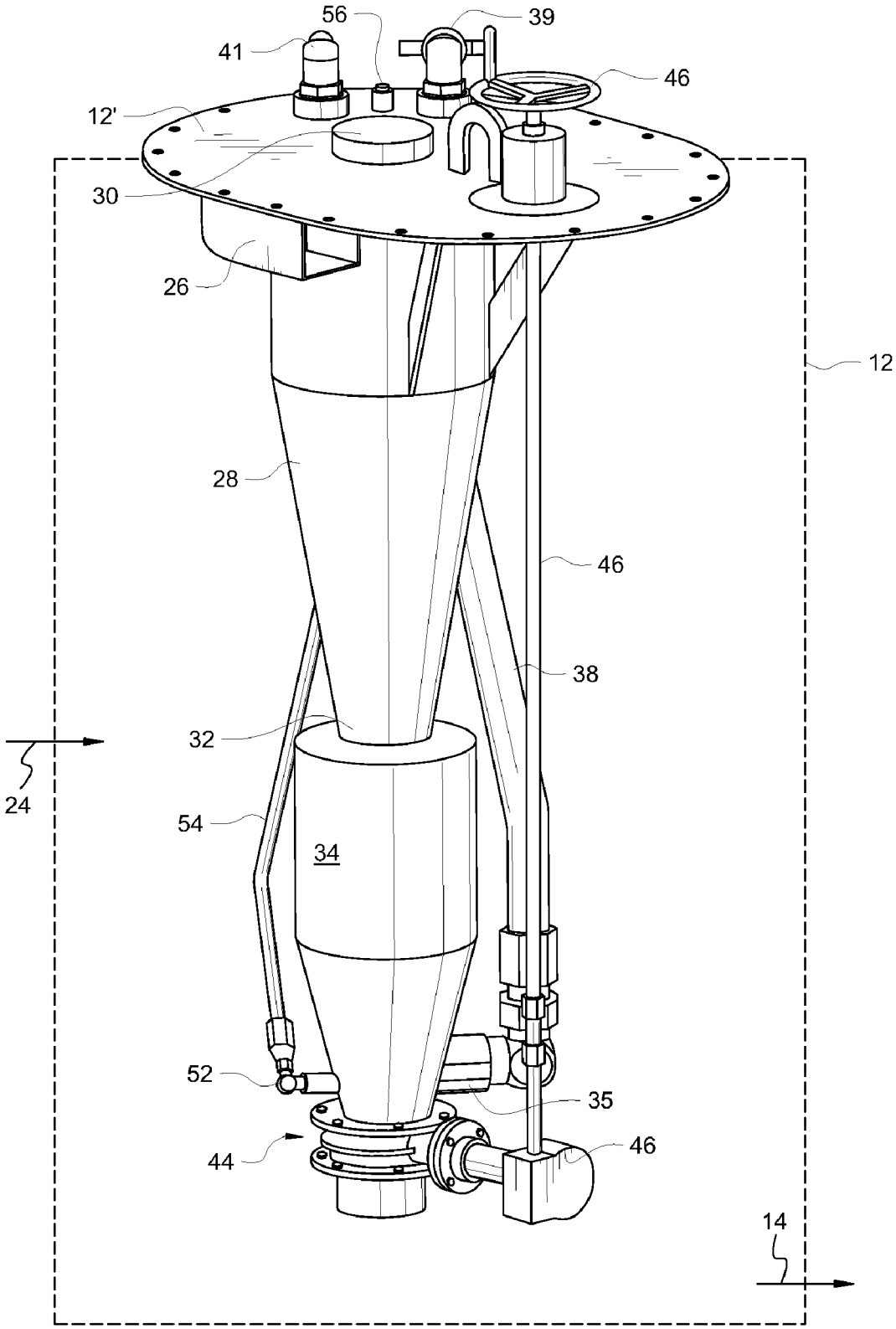
FIG. 3 is a perspective view of the FIG. 2 embodiment of a cyclone separator system from a second direction.

FIGS. 2 and 3 provide two perspective views of an embodiment wherein the cyclone separator 28 and collection container 34 are physically positioned within the supply tank 12. In these figures, parts corresponding to parts shown in FIG. 1 are identified by the same reference numbers. A plate 12' forms a part of the top of the tank 12. The plate 12' also forms the top of the separator 28. The clean air vent 30 extends through the plate 12'. The plate 12' and other portions of cyclone separator 28 may be made of steel. The upper portion of the separator 28 may have a diameter at inlet 26 of about twelve inches and a diameter at solids outlet 32 of about four inches. The collection container 34 may be connected directly to the outlet 32. The lower end of collection container 34 is closed by a butterfly valve 44, which remains closed during transfer of materials into the supply tank 12. A manual crank system 46 is provided for opening the valve 44 from the outside of the tank 12.

In this embodiment, the flow path 38 between collection container 34 and the inlet of pump 36 includes a conduit extending from an outlet 35 in the lower portion of collection container 34 to a fitting 39 on the top of plate 12' and therefore outside tank 12. A second fitting 41 on the top of plate 12' is connected to a short pipe nipple 50 passing through the plate 12' to flow the materials from pump 36 back into the tank 12. The fitting 39 is adapted for connection to the suction inlet of pump 36 and the fitting 41 is adapted for connection to the outlet of pump 36. The pump 36 may therefore be located outside tank 12.

In this embodiment, an inlet 52 is provided in the lower end of collection container 34 about opposite the outlet 35. The inlet 52 is connected by a conduit 54 to a fitting 56 on the upper surface of plate 12'. The fitting 56 is adapted for connection to a source of pressurized air. This air inlet system provides a means for fluidizing any powder which might plug the outlet 35 and interfere with operation of the pump 36.

In operation, the elements shown in FIGS. 2 and 3 are assembled and inserted into an appropriately shaped opening in the top of supply tank 12. The plate 12' is attached to tank 12 by appropriate fasteners and gasket material to prevent any powder from being vented around the plate 12'. Before the mixer 16 of FIG. 1 can be operated, an appropriate amount of dry treating material must be transferred into the supply tank 12 to provide accurate metering of the material into the mixer 16. As the dry treating material is transferred into the supply tank 12, the air used for the pneumatic conveyance flows into the inlet 26 of the cyclone separator 28. As the air spins in the separator 28, the solids are separated and fall through outlet 32 into the collection container 34. Clean air is vented from outlet 30.

The pump 36 is turned on, in this case by supplying pressurized air to the pump. The pump 36 draws the powder material from the outlet 35 of the collection container 34 and pumps it back into supply tank 12 via short pipe nipple 50. The pump 36 also pumps air with the powder, and this air flows into the inlet 26 of separator 28 which removes any entrained powder or dust.

If for any reason the material in collection container 34 should compact so as to plug or block the outlet 35, a source of pressurized air may be connected to the fitting 56 on plate 12'. The pressurized air will flow through the conduit 54 and inlet 52. The inlet 52 is positioned so that the air is directed toward the outlet 35 and will fluidize any powder and assist in moving it into the outlet 35.

When the pump 36 discussed above is operating, it will pump air from the collection container 34 and return it to the supply tank 12 through the fitting 41 and pipe 50. This circulating air is the fluid which moves the dust from the collection container 34 and conveys it back into the supply tank 12. Any other pump arrangement or air conveyance device that can move air from the collection container 34 and back into the tank 12 may also be effective to convey dust from the collection container 34. As discussed above, the inlet 52 is positioned to direct a flow of compressed air toward the flow path 38 which forms the outlet from the collection container 34. By proper sizing of the inlet 52 to provide an air jet, and proper shaping of the outlet 35, these parts may operate as a solids conveying eductor or jet pump. A constant supply of pressurized air may be supplied to the fitting 56 to power such a pump. In the embodiment of FIGS. 2 and 3, the fittings 39 and 41 may be connected by a length of conduit to re-circulate air driven by such a pump back into the supply tank 12. Thus, the pump 36 may be an air driven solids conveying eductor or jet pump formed or positioned in the collection container 34, an air operated diaphragm pump located outside tank 12, or both. In either of these embodiments, the pump 36 may be operated by a supply of pressurized air 37 as indicated in FIG. 1.

When a well treatment job is finished, it may be desirable to empty all powder or granular material from the supply tank 12, the separator 28, the collection container 34, etc. For example it may be desirable to perform another treatment with another material. If all treatments are finished, it may be desirable to empty and clean the portable mixing system before transporting it to another well site. The manually operated valve 44 may be opened and allows access through clean air outlet 30 to and through the separator 28 and collection container 34 to the interior of the tank 12 for inspection and cleaning.

While the embodiments have been described primarily with reference to dry gel materials used in treating wells, they are useful for other well treating materials. Cement, e.g. Portland cement, is used for cementing casing in wells and for other purposes. Such cement is delivered in powder form and must be mixed with water as it is needed to form a slurry for pumping into a well. The system described herein is useful for mixing cement for such purposes.

In the disclosed embodiment, the bulk storage tank 22 may be a tank truck. Other bulk storage means are also used at well sites. The dry treating material may be temporarily transferred from tanker trucks into fixed storage containers erected at a well site. For offshore operations, the dry treating materials may be delivered by and stored in a barge until needed or may be transferred from a barge into a bulk storage tank on a drill ship or platform.

While the embodiments are described as being portable and truck mounted, they may be skid mounted, for example for use in offshore well sites. Skid mounted systems are typically moved over land by truck, and thus have the same size limitations as truck mounted systems.

In the embodiment of FIGS. 2 and 3, the cyclone separator 28 and its collection container 34 are located within the supply tank 12. This arrangement has advantages, especially in a portable system. However, the cyclone separator 28 and its collection container 34 may be located outside the supply tank 12 if desired. Likewise, pump 36 may be located inside or outside the supply tank 12.

While the present invention has been illustrated and described with respect to particular equipment and arrangements of equipment, it is apparent that various substitutions of equivalent elements and rearrangement of the elements may be made within the scope of the present invention as defined by the appended claims.

What we claim as our invention is:

1. A portable well treating fluid mixing system, comprising:

a supply tank having an inlet receiving pneumatically conveyed dry treating material;

a cyclone separator having an inlet coupled to and receiving dust laden air from the supply tank, having a first outlet venting clean air, and having a second outlet discharging solids;

a collection container having a first inlet coupled to the cyclone separator second outlet, the collection container inlet receiving solids from the cyclone separator, the collection container having a second inlet adapted for connection to a supply of compressed air, and the collection container having an outlet; and a pump having an inlet coupled to the collection container outlet, and having an outlet coupled to the supply tank.

2. The portable well treating fluid mixing system of claim 1, wherein the pump is an air driven diaphragm pump.

3. The portable well treating fluid mixing system of claim 1, further comprising:

a bulk storage tank containing the dry treating material, and a pneumatic conveyor having an inlet coupled to the bulk storage tank and having an outlet coupled to the supply tank.

4. The portable well treating fluid mixing system of claim 1, wherein the supply tank has an outlet providing a flow of the dry treating material, further comprising:

a mixer having a first inlet coupled to the supply tank outlet, having a second inlet coupled to a supply of liquid, and having an outlet providing a flow of treating fluid.

5. The portable well treating fluid mixing system of claim 1, wherein the collection container second inlet is positioned to direct a flow of air toward the collection container outlet.

6. The portable well treating fluid mixing system of claim 1, wherein the collection container second inlet comprises an air jet, and the air jet and the collection container outlet form the pump.

7. The portable well treating fluid mixing system of claim 1, wherein the collection container has a second outlet, further comprising:

a valve manually operable to selectively open and close the second outlet.

8. The portable well treating fluid mixing system of claim 1, wherein the cyclone separator and the collection container are located within the supply tank.

9. A portable well treating fluid mixing system, comprising:

a supply tank having an inlet receiving pneumatically conveyed dry treating material;

a cyclone separator having an inlet coupled to and receiving dust laden air from the supply tank, having a first outlet venting clean air, and having a second outlet discharging solids;

a collection container having a first inlet coupled to the cyclone separator second outlet, the collection container inlet receiving solids from the cyclone separator, the collection container having an outlet; and a pump having an inlet coupled to the collection container outlet, and having an outlet coupled to the supply tank;

wherein the collection container has a second inlet adapted for connection to a supply of compressed air, the second inlet positioned to direct a flow of air toward the collection container outlet.

10. The portable well treating fluid mixing system of claim 9, wherein the pump is an air driven diaphragm pump.

11. The portable well treating fluid mixing system of claim 9, further comprising:

a bulk storage tank containing the dry treating material, and a pneumatic conveyor having an inlet coupled to the bulk storage tank and having an outlet coupled to the supply tank.

12. The portable well treating fluid mixing system of claim 9, wherein the supply tank has an outlet providing a flow of the dry treating material, further comprising:

a mixer having a first inlet coupled to the supply tank outlet, having a second inlet coupled to a supply of liquid, and having an outlet providing a flow of treating fluid.

13. The portable well treating fluid mixing system of claim 9, wherein the collection container second inlet comprises an air jet, and the air jet and the collection container outlet form the pump.

14. The portable well treating fluid mixing system of claim 9, wherein the collection container has a second outlet, further comprising:

a valve manually operable to selectively open and close the second outlet.

15. A portable well treating fluid mixing system, comprising:

a supply tank having an inlet receiving pneumatically conveyed dry treating material;

a cyclone separator having an inlet coupled to and receiving dust laden air from the supply tank, having a first outlet venting clean air, and having a second outlet discharging solids;

a collection container having a first inlet coupled to the cyclone separator second outlet, the collection container inlet receiving solids from the cyclone separator, the collection container having an outlet;

a pump having an inlet coupled to the collection container outlet, and having an outlet coupled to the supply tank; and a valve manually operable to selectively open and close a second outlet of the collection container.

16. The portable well treating fluid mixing system of claim 15, wherein the pump is an air driven diaphragm pump.

17. The portable well treating fluid mixing system of claim 15, further comprising:

a bulk storage tank containing the dry treating material, and a pneumatic conveyor having an inlet coupled to the bulk storage tank and having an outlet coupled to the supply tank.

18. The portable well treating fluid mixing system of claim 15, wherein the supply tank has an outlet providing a flow of the dry treating material, further comprising:

a mixer having a first inlet coupled to the supply tank outlet, having a second inlet coupled to a supply of liquid, and having an outlet providing a flow of treating fluid.

19. The portable well treating fluid mixing system of claim 15, wherein the collection container has a second inlet adapted for connection to a supply of compressed air.

20. The portable well treating fluid mixing system of claim 15, wherein the cyclone separator and the collection container are located within the supply tank.

* * * * *